US006198223B1

(12) United States Patent
Scholz

(10) Patent No.: US 6,198,223 B1
(45) Date of Patent: Mar. 6, 2001

(54) CAPACITIVE GLOW STARTING OF CERAMIC HIGH INTENSITY DISCHARGE DEVICES

(75) Inventor: John A. Scholz, Georgetown, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/184,820

(22) Filed: Nov. 2, 1998

Related U.S. Application Data

(60) Provisional application No. 60/090,492, filed on Jun. 24, 1998.

(51) Int. Cl.[7] ..... H01J 17/18

(52) U.S. Cl. ..... 313/623; 313/607; 313/601; 313/234

(58) Field of Search ..... 313/623, 631, 313/594, 601, 602, 607, 632, 634, 637, 638, 234; 315/344

(56) References Cited

U.S. PATENT DOCUMENTS 4,818,915 4/1989 Zaslavsky et al. ..... 315/60
5,323,091 * 6/1994 Morris ..... 315/344
5,424,609 6/1995 Geven et al. ..... 313/623
5,828,185 * 10/1998 Fellows et al. ..... 315/246
5,998,939 * 12/1999 Fellows et al. ..... 315/246

* cited by examiner

*Primary Examiner*—Ashok Patel
*Assistant Examiner*—Karabi Guharay
(74) *Attorney, Agent, or Firm*—W. H. McNeill

(57) ABSTRACT

An arc tube for a discharge lamp comprises an hermetically sealed hollow body containing an arc generating and sustaining medium therein and having first and second ends. An electrode receiving capillary extends from each end and an electrode structure is positioned in each of the capillaries. Each of the electrode structures comprises a proximal, electrode end projecting into the interior of the hollow body, a distal end projecting exteriorly of the capillary, and an intermediate section therebetween, a first area of the intermediate section being sealed to the capillary in an hermetic manner and a second area of the intermediate section being exposed to the medium. A starting aid comprises an electrically conducting member surrounding the capillary extending from the first end at the second area of the intermediate section and is electrically connected to the distal end of the electrode structure positioned in the second end. The starting aid provides a capacitively coupled ionization mechanism for starting the lamp.

5 Claims, 2 Drawing Sheets

CAPACITIVE GLOW STARTING OF CERAMIC HIGH INTENSITY DISCHARGE DEVICES

This application claims the benefit of Provisional Application Ser. No. 60/090,492, filed Jun. 24, 1998.

TECHNICAL FIELD

This invention relates to starting aids and more particularly to starting aids for high intensity discharge lamps. It has particular application to high intensity discharge lamps utilizing ceramic arc tubes.

BACKGROUND ART

Arc discharge lamps require a ballast for operation. The ballast supplies the requisite open circuit voltage to start and maintain an arc in the discharge tube as well as limiting the current through the discharge tube. One type of ballast uses a high voltage pulse to initiate breakdown in the discharge tube. Arc tube breakdown is the first phase of lamp starting and is therefore essential for lamp operation. The typical high voltage pulse for a ballast of this type has an amplitude between three and four kilovolts (Kv) with a pulse width of 1.0 $\mu$s at 2.7 Kv. There are two commercial ballast methods for applying the typical voltage to the lamp. The first method applies the pulse voltage to the center contact of the lamp base; and the second method divides the pulse between the center contact and the shell of the base. The second method, referred to as the split lead design, has an unusual characteristic, floating the lamp lead wires such that both lamp wires carry pulse voltage with respect to ground. When the pulse voltage is applied to the lamp, 1.7 Kv is applied to the center contact of the lamp and an opposite potential of approximately equal magnitude is applied to the shell of the lamp base.

There is now available a relatively new type of ceramic arc tube that utilizes a design that contains essentially three distinct sections. See, for example, U.S. Pat. Nos. 4,795,943 and 5,424,609. See also, Attorney Docket Nos. 96-1-213 and 97-1-009, filed Oct. 2, 1998 and incorporated herein by reference. The three sections are: the main, central body or arc chamber where the discharge takes place and two legs, one on either side of the body, which contain the electrode structure and the lead-ins therefor. The electrode structure comprises an external lead, an internal lead and an electrode. The internal lead connects the external lead to the electrode that is located within the arc chamber. The arc chamber, of course, also houses the arc generating and sustaining medium. The arc chamber, and thus the medium, continues into each of the opposed legs that contain the electrode structure.

One of the characteristic advantages of the preformed and presized ceramic arc tubes over their quartz predecessors is the consistent lamp to lamp geometry. This geometric uniformity results in consistent heat transfer mechanisms and consistent radiation from the arc tube. This consistency greatly enhances lamp performance. Such lamps are observed to have minimum lamp to lamp variations of color temperature, lumen output and color rendering index.

It is often necessary to use a glow bottle in addition to a ballast that supplies high voltage to start discharge lamps. These glow bottles comprise a hermetically sealed capsule, usually of quartz, which contain a partial pressure (i.e., <1 atmosphere) of argon, nitrogen or other gas mixtures. They may additionally contain a partial pressure of mercury. These glow bottles contain an additional lead-in that facilitates the "glow" or ionization of their contained gases when a sufficient potential is applied to the glow bottle lead-in. The glass vessel of the glow bottle must be in close proximity to a lead-in of the opposite potential for the ionization of the enclosed gas to occur. Upon energization of the glow bottle, UV is generated, which UV initiates the arc discharge in the lamp. Such glow bottles are shown in U.S. Pat. No. 4,818,915.

The use of glow bottles, while effective, adds to the cost of the lamp and, furthermore, is generally not possible to use with a ceramic arc tube. Such ceramic arc tubes are usually encased in an aluminosilicate outer jacket that closely surrounds the arc tube leaving insufficient room to allow adequate placement of the glow bottle. Also, since the aluminosilicate outer jacket is an effective absorber of UV radiation, it is not effective to place a glow bottle outside of the jacket.

Further, since the environment between the inside of the outer jacket and the arc tube must be a vacuum when a ceramic arc tube is employed, it is not possible to use that environment as a source of UV radiation to enhance starting.

Other methods that are being employed facilitate lamp starting use hazardous materials such as radioactive krypton 85.

DISCLOSURE OF INVENTION

It is, therefore, an object of this invention to obviate the disadvantages of the prior art.

It is another object of the invention to provide a starting aid for a ceramic arc tube lamp.

Yet another object of the invention is the enhancement of lamp performance.

These objects are accomplished, in one aspect of the invention, by the provision of an arc tube for a discharge lamp which comprises an hermetically sealed hollow body containing an arc generating and sustaining medium and having first and second ends; an electrode receiving capillary extending from each end; an electrode structure positioned in each of said capillaries, each of said electrode structures comprising a proximal, electrode end projecting into the interior of said hollow body, a distal end projecting exteriorly of said capillary, and an intermediate section therebetween, a first area of said intermediate section being sealed to said capillary in an hermetic manner and a second area of said intermediate section being exposed to said medium; and a starting aid comprising an electrically conducting member surrounding said capillary extending from said first end at said second area of said intermediate section and being electrically connected to the distal end of the electrode structure positioned in said second end.

The starting aid activates a glow discharge in the space behind the electrode to achieve starting. The glow bottle is eliminated, thus reducing parts cost and assembly costs.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
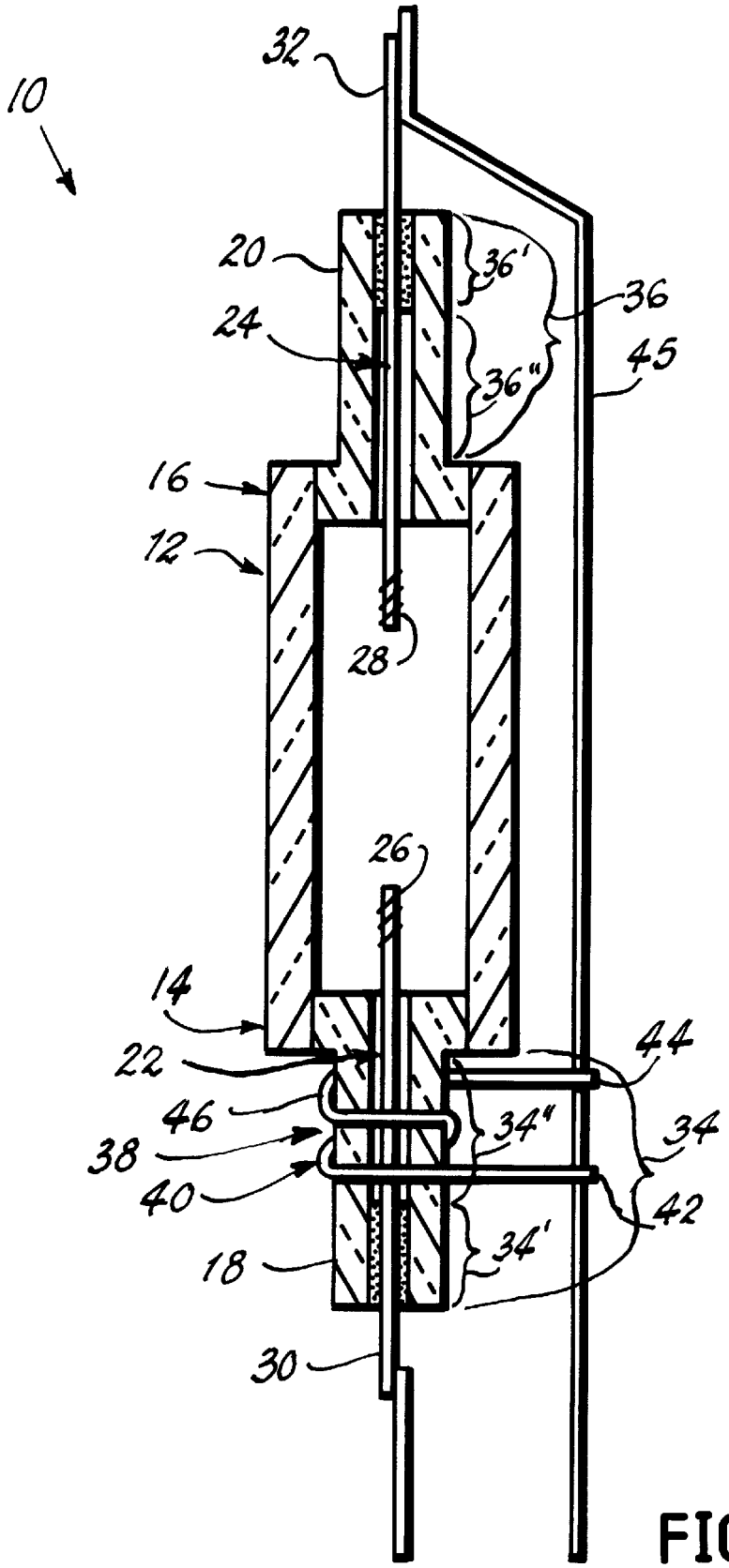
FIG. 1 is an elevational, sectional view of an arc tube embodying the invention.

Referring now to the drawings with greater particularity, there is shown in FIG. 1 an arc tube 10 for a discharge lamp, which can be a metal halide lamp. The arc tube 10, which is preferably constructed from alumina having one or minor additives contained therein, has an hermetically sealed, hollow body 12 containing an arc generating and sustaining medium in the interior thereof. Body 12 can be cylindrical as shown or elliptical or other suitable shape. The body 12 has a first end 14 with an electrode receiving capillary 18 extending therefrom and a second end 16 with an electrode receiving capillary 20 extending therefrom. Electrode structures 22 and 24 are positioned, respectively, in capillaries 18 and 20. Electrode structure 22 comprises a proximal electrode end 26 projecting into the interior of hollow body 12, a distal end 30 that projects exteriorly of capillary 18, and an intermediate section 34 therebetween. The intermediate section 34 has a first area 34' that is sealed to the capillary 18 in an hermetic manner and a second area 34" which is exposed to the arc generating and sustaining medium.

Likewise, electrode structure 24 comprises a proximal electrode end 28 projecting into the interior, a distal end 32 projecting exteriorly of capillary 20 and an intermediate section 36 therebetween. The intermediate section 36 has a first area 36' that is sealed to capillary 20 and a second area 36" that is exposed to the medium.

A starting aid 38 surrounds capillary 18 and comprises an electrically conducting member 40 positioned about the second area 34". It has its ends 42, 44, electrically connected to the distal end 32 of electrode structure 24 via a connecting wire 45. In a preferred embodiment, the starting aid 38 comprises a coil of at least one turn of wire 46.

This construction thus provides a capacitively coupled ionization mechanism that is performed in the leg of the arc tube itself, rather than in a separate glow bottle or the gas environment of the outer jacket or the gas environment of an inner jacket.

Figure 2:
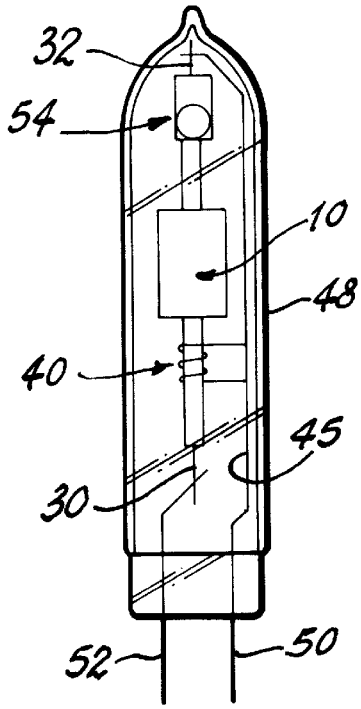
FIG. 2 is an elevational view, partly in section, of an embodiment of the invention in a shield.

Referring now to FIG. 2, the arc tube 10, with its starting aid 40, is sealed into an evacuated jacket 48, which is preferably formed from an aluminosilicate or borosilicate glass. A terminal portion 50 of connecting wire 45 and a lead-in wire 52, connected to distal end 30, are sealed into and extend from the jacket 48 so that electrical connection can be made to the arc tube 10. A getter 54 is attached to the distal end 32 to maintain the gas-free environment within the jacket 48.

Figure 3:
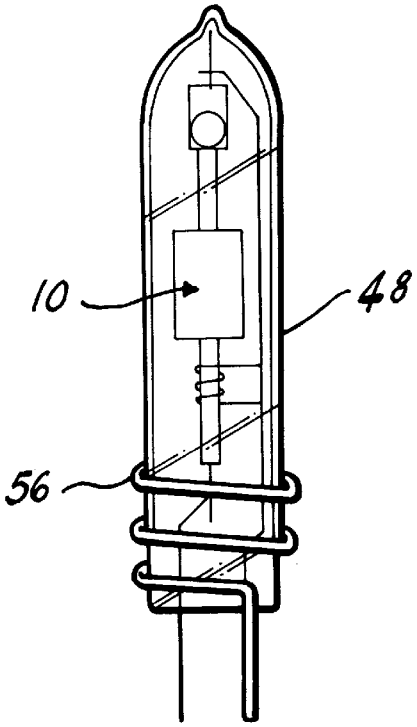
FIG. 3 is a similar view with an alternate embodiment of the invention.

A similar construction is shown in FIG. 3 wherein a spiral mounting aid 56 surrounds the base of the jacket 48 and is affixed to the jacket by attachment to terminal portion 50.

Figure 4:
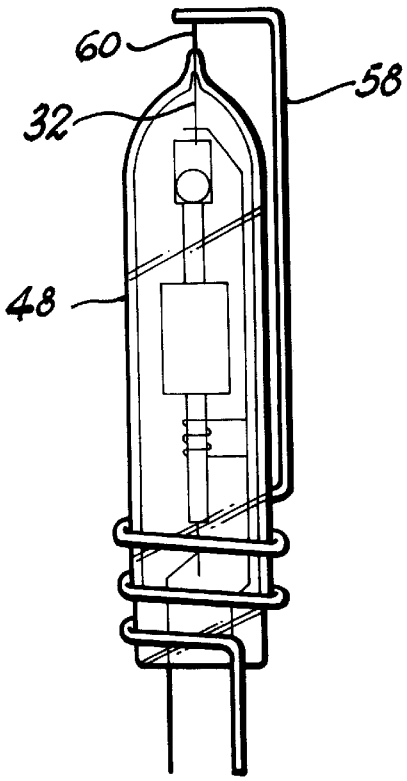
FIG. 4 is a similar view of yet another alternate embodiment of the invention.

FIG. 4 details a similar structure wherein an end 58 of the mounting aid 56 is elongated and make both mechanical and electrical connection to a terminus 60 of distal end 32 which projects beyond the jacket 48.

Figure 5:
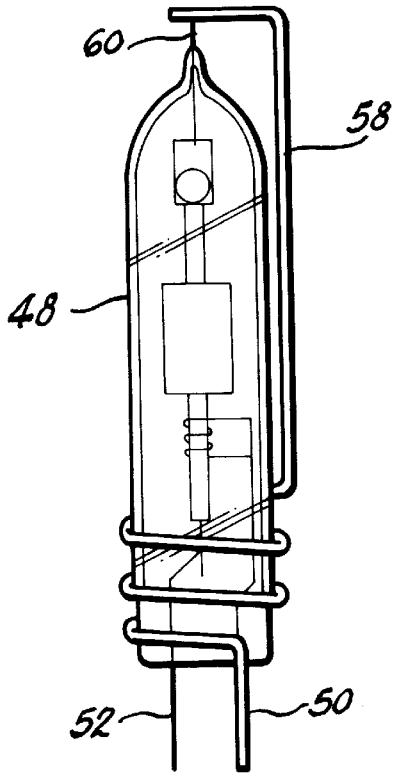
FIG. 5 is a similar view of still another embodiment of the invention.

FIG. 5 illustrates yet another embodiment wherein the only electrical connection to distal end 32 occurs externally of the jacket 48 via end 58 and terminus 60. Starting aid 40 is connected to electrode end 28 via terminal portion 50 and end 58.

Further details on the use of the spiral mounting aid 56 can be found in U.S. patent application Ser. No. 09/041,295, filed Mar. 12, 1998, and assigned to the assignee of the present invention. As shown therein, the jacketed structure herein described is ideally suited for incorporation into PAR lamps.

There is thus provided a starting aid for ceramic arc tubes that does not require additional glow bottles nor the use of hazardous materials such as radioactive krypton 85 gas.

While there have been shown and described what are at present considered the preferred embodiments of the invention, it will be apparent to those skilled in the art that various changes and modifications can be made herein without departing from the scope of the invention as defined by the appended claims.

What is claimed is:

1. An arc tube assembly for a discharge lamp comprising: an hermetically sealed hollow arc tube body sealed within a vacuum-containing shield said hollow arc tube body containing an arc generating and sustaining medium therein and having first and second ends; an electrode receiving capillary extending from each end; an electrode structure positioned in each of said capillaries, each of said electrode structures comprising a proximal, electrode end projecting into the interior of said hollow arc tube body, a distal end projecting exteriorly of said capillary, and an intermediate section therebetween, a first area of said intermediate section being sealed to said capillary in an hermetic manner and a second area of said intermediate section being exposed to said medium; and a starting aid positioned within said vacuum-containing shield and comprising an electrically conducting member surrounding said capillary extending from said first end at said second area of said intermediate section and being electrically connected to the distal end of the electrode structure positioned in said second end via an electrical connection that is external of said vacuum-containing shield.

2. The arc tube of claim 1 wherein said starting aid comprises multiple turns of wire.

3. The arc tube of claim 1 wherein said arc tube is composed substantially of alumina.

4. The arc tube of claim 1 wherein said shield is composed of a material selected from borosilicate and aluminosilicate glasses.

5. The arc tube assembly of claim 1 wherein said electrical connection in an area remote from said distal end includes a spiral winding surrounding said vacuum-containing shield.

* * * * *